US008171827B2

(12) United States Patent
Gareis

(10) Patent No.: US 8,171,827 B2
(45) Date of Patent: May 8, 2012

(54) POWER SCREWDRIVER

(75) Inventor: Marc Gareis, Leonberg (DE)

(73) Assignee: LOESOMAT Schraubtechnik Neef GmbH, Vaihingen/Enz (DE)

( * ) Notice: Subject to any disclaimer, the term of this patent is extended or adjusted under 35 U.S.C. 154(b) by 362 days.

(21) Appl. No.: 12/451,014

(22) PCT Filed: Apr. 21, 2008

(86) PCT No.: PCT/DE2008/000677

§ 371 (c)(1),
(2), (4) Date: Nov. 20, 2009

(87) PCT Pub. No.: WO2008/128525

PCT Pub. Date: Oct. 30, 2008

(65) Prior Publication Data

US 2010/0101381 A1 Apr. 29, 2010

(30) Foreign Application Priority Data

Apr. 23, 2007 (DE) ..... 10 2007 019 408

(51) Int. Cl.
*B25B 23/147* (2006.01)

(52) U.S. Cl. ..... 81/479; 81/469

(58) Field of Classification Search ..... 81/467, 81/477, 479, 469; 173/176, 181, 182, 183
See application file for complete search history.

(56) References Cited

U.S. PATENT DOCUMENTS 3,845,373 A 10/1974 Totsu et al.
3,892,146 A * 7/1975 Yasoshima ..... 81/469
4,463,293 A * 7/1984 Hornung et al. ..... 318/284
4,979,408 A * 12/1990 Hayashi ..... 81/477
5,315,501 A 5/1994 Whitehouse
5,918,685 A 7/1999 Ulbrich et al.
6,161,629 A * 12/2000 Hohmann et al. ..... 173/181
6,913,087 B1 * 7/2005 Brotto et al. ..... 173/1
7,011,000 B2 * 3/2006 Kushida et al. ..... 81/302

(Continued)

FOREIGN PATENT DOCUMENTS

DE 23 26 027 12/1973

(Continued)

OTHER PUBLICATIONS

Machine translation of DE 28 06 553 A1 into english, The McElroy Translation Company, Dec. 2011.*

(Continued)

*Primary Examiner* — David B Thomas
(74) *Attorney, Agent, or Firm* — Collard & Roe, P.C.

(57) ABSTRACT

The invention relates to a power screwdriver (10) comprising a motor (12) and a control circuit (22) which switches the motor (12) off by means of a switch-off signal (s_Stop) when it reaches a preset desired torque value (Md_Soll), and a supporting arm (18) which absorbs energy during screwing. The invention is characterized by a voltage limiting circuit (46) that limits the motor voltage (u_Mot) occurring on the motor (12) when the energy stored in the supporting arm (18) of the motor (12), which is driven as the generator and rotates counter to the direction of drive, is dissipated, to a predetermined limiting voltage (u_Lim). The limiting voltage (u_Lim) is fixed in such a manner that the motor (12) is capable of rotating without counter-torque counter to the direction of drive when operated in the generator mode and that yet no inadmissible overvoltages occur.

13 Claims, 3 Drawing Sheets

U.S. PATENT DOCUMENTS

| | | | | |
|---|---|---|---|---|
| 7,109,675 | B2 * | 9/2006 | Matsunaga et al. | 318/433 |
| 7,235,940 | B2 | 6/2007 | Bosch et al. | |
| 7,331,406 | B2 * | 2/2008 | Wottreng et al. | 173/176 |
| 7,456,608 | B2 | 11/2008 | Kageler et al. | |
| 2010/0116519 | A1 * | 5/2010 | Gareis | 173/176 |

FOREIGN PATENT DOCUMENTS

| | | |
|---|---|---|
| DE | 28 06 553 | 8/1979 |
| DE | 43 10 936 | 10/1993 |
| DE | 196 20 782 | 12/1996 |
| DE | 196 26 731 | 1/1998 |
| DE | 196 47 813 | 6/1998 |
| DE | 201 13 184 | 9/2002 |
| DE | 102 58 900 | 7/2004 |
| DE | 103 41 975 | 4/2005 |
| DE | 103 45 135 | 4/2005 |
| DE | 10 2005 056 264 | 5/2007 |
| DE | 10 2006 017 193 | 10/2007 |
| EP | 0 187 353 | 7/1986 |
| EP | 1 339 152 | 8/2003 |

OTHER PUBLICATIONS

International Search Report.

Littelfuse, "Transient Suppression Devices and Principles," Application Note AN9768, vol. 01/1998, Jan. 1998, pp. 102-109, XP-002497185. http://www.littelfuse.com/data/en/Application_Notes/an9768.pdf (ISR).

Littelfuse, "Littelfuse Varistors—Basic Properties, Terminology and Theory," Application Note AN9767, vol. 07/1999, Jul. 1999, pp. 89-101, XP-002497128. http://www.littlefuse.com/data/en/Application_Notes/Littelfuse_app-note_an9767.pdf (ISR).

* cited by examiner

POWER SCREWDRIVER

CROSS REFERENCE TO RELATED APPLICATIONS

This application is the National Stage of PCT/DE2008/000677 filed on Apr. 21, 2008, which claims priority under 35 U.S.C. §119 of German Application No. 10 2007 019 408.2 filed on Apr. 23, 2007. The international application under PCT article 21(2) was not published in English.

The invention starts from a power screwdriver according to the generic part of the independent claim.

PRIOR ART

DE 23 26 027 A describes a mains voltage-operated screwdriver which provides a specified desired torque value. The torque applied by the screwdriver is directly detected based on the current flowing through the electric motor. Owing to the mains connection, an operating voltage of the electric motor is assumed that is at all times the same and constant. If the desired torque value has not yet been reached, the screwdriver rotates at the maximum possible speed which is dependent on the desired torque value to be applied. Owing to the mass inertia of the rotating parts of the screwdriver, such as the electric motor and in particular the gear mechanism, the screwed connection still continues to be rotated as a function of the after-run after the desired torque value has been reached.

The problems occurring in DE 23 26 027 A1 owing to the continued rotation of the screwdriver when the desired torque value has been reached are taken up by DE 103 41 975 A1. An electronic torque limiting device is described for an electric motor used, for example, in a battery-operated screwdriver. The starting point is an electronic torque limitation element in which the current flowing through the electric motor is adduced as a measure of the torque. A procedure of this type is described as being inaccurate because, in particular at high speeds, the kinetic energy of the rotating masses, after the electric motor has been switched off, can cause an after-run with the consequence that a screwed connection having a higher torque than the specified desired torque value is adduced. In order to avoid the torque peak, which is based on the mass inertia or the dynamics of the gear mechanism, it is proposed that the maximum value of the admissible electric motor current be defined as a function of the speed of the electric motor. According to one exemplary embodiment, a desired torque value may be defined that is converted to a maximum value of the electric motor current. The higher the maximum value of the electric motor current is set, the lower the maximum speed of the electric motor may become.

EP 0 187 353 A2 describes a screwdriver, the electric motor of which is supplied by the alternating voltage network. The starting point is the finding that the electric motor provides a maximum and determined torque under load while stationary, this torque being dependent on the provided voltage or the load current in accordance with the respective characteristic curve. The average operating voltage of the electric motor is set using a switching element which is embodied, for example, as a triac. The average operating voltage of the electric motor or the load current can be set using a potentiometer, allowing the maximum torque to be varied and to be set when the motor is stationary or at low motor speeds. The desired torque value of the screw joint is reached at a low speed of the screwdriver or even when the screwdriver is stationary, so that an overshoot of the desired torque value is prevented by an after-run.

A compensation circuit is also provided that is able to compensate for fluctuations of the mains voltage in order to eliminate the influence on the actual torque value. If the supply voltage falls, the phase gating angle in the triac activator is increased in size, so that a higher average voltage is applied to the electric motor.

DE 196 26 731 A1 describes a small, battery-operated screwdriver containing a switching element which switches off the electric motor by short-circuiting. The switching element is actuated by a depth stop. An overshoot is avoided as a result of the abrupt braking of the electric motor. However, it must in this case be borne in mind that such short-circuiting of the electric motor is possible only at comparatively low torques to be delivered, of up to for example 100 Nm, and in inefficient electric motors, as, even in inefficient electric motors, allowance must be made, in the case of short-circuiting of an electric motor rotating at high speed, for a considerable short-circuit current and the electromagnetic disturbances associated therewith. The short-circuit current places considerable stress both on a collector of an electric motor embodied as a DC motor and on the switching element used for short-circuiting the electric motor.

DE 103 45 135 A1 describes a small, battery-operated screwdriver containing a lithium ion battery for supplying energy.

It is generally known in the art to provide, in parallel to an electric motor, a free-wheeling circuit which allows current dissipation of the inductive energy stored in the inductive component of the electric motor after the electric motor has been switched off. The free-wheeling circuit may for example be embodied as a switched free-wheeling circuit in which, for example, a MOS field effect transistor, which is connected in parallel to the electric motor, is switched on at the same time as the switching-off of the power supply and thus bridges the electric motor, so that the motor current can be dissipated. In the simplest case, the free-wheeling circuit is embodied by a free-wheeling diode connected in parallel to the electric motor. A free-wheeling circuit of this type merely allows the motor current to continue to flow after the power supply has been switched off, wherein the voltage set on the motor is not defined when the free-wheeling circuit is active, but is dependent on the forward voltage of the current-bearing free-wheeling component used, the forward voltage being highly temperature-dependent and, in particular, dependent on the amount of the free-wheeling current.

DE 201 13 184 U1 and for example DE 196 47 813 A1 disclose screwdrivers which are configured as hand-held power tools, are operated by an electric motor and each have a supporting arm for providing a counter-torque during tightening or releasing of screwed connections.

Screwdrivers of this type are referred to as power screwdrivers because the torque provided may be up to, for example, 10,000 Nm; such a torque could not be applied by an operator of the power screwdriver without the supporting arm. As the torque increases during the screwing process, the supporting arm is elastically deformed, as a result of which the supporting arm absorbs energy. During the screwing process the supporting arm braces the screwdriver on the screwed connection. The supporting arm absorbs by deformation not only the energy occurring during the screwing process, but also the rotational energy remaining in the rotating masses, such as for example the electric motor and in particular the gear mechanism, after the power screwdriver has been switched off.

The bracing can for example be released by a slip coupling which mechanically disengages when the desired torque value has been reached. In particular at low desired torque values, the drive unit can release the tensioning by specifying a defined power. In both methods the markedly different mass ratio of the rotating drive unit in relation to the mass of the gear mechanism has an adverse effect on the gear mechanism and the electric motor.

In the case of screwdrivers, in particular in the case of power screwdrivers, which can provide a very high torque, it is essential that the energy stored in the supporting arm can be dissipated in a controlled manner, so that the power screwdriver can be detached from the screwed connection. Owing to the generally high step-down ratio of the gear mechanism, it is not possible to rule out the chance of the electric motor beginning to rotate, owing to the energy stored in the supporting arm, counter to the direction of drive.

The invention is based on the object of disclosing a power screwdriver, in particular a battery-operated power screwdriver, which allows safe dissipation of the energy stored in the supporting arm after the power screwdriver has been switched off.

The object is achieved by the features disclosed in the independent claim.

DISCLOSURE OF THE INVENTION

The power screwdriver according to the invention has an electric motor and an activation circuit which switches off the electric motor by means of a switch-off signal when a set desired torque value has been reached. A supporting arm is also provided that absorbs energy during the screwing process. The power screwdriver according to the invention is distinguished by a voltage limiter circuit that limits to a specified limiting voltage (u_Lim) the motor voltage (u_Mot) which occurs on the electric motor (12) which is operated as a generator during the dissipation of the energy stored in the supporting arm (18) and rotates counter to the direction of drive.

The voltage limiter circuit provided in accordance with the invention first ensures that the energy stored in the supporting arm during the screwing process can be consumed, after the electric motor has been switched off on reaching the desired torque value, by driving the electric motor via the gear mechanism in generator mode, wherein the electric motor does not build up any significant counter-torque below the specified limiting voltage in a broad speed range.

In particular, the voltage limiter circuit provided in accordance with the invention protects the activation circuit from inadmissibly high voltages which might occur in the case of a large amount of energy stored in the supporting arm, after the electric motor has been switched off on reaching the desired torque value, in accordance with a high speed of the electric motor in generator mode.

Advantageous developments and embodiments of the power screwdriver according to the invention emerge from dependent claims.

One embodiment provides for the limiting voltage to correspond in terms of amount at least to the nominal operating voltage of the electric motor. On the one hand, this provides an adequate speed range during operation of the generator without the occurrence of a current flow which can occur only when the limiting voltage has been reached. On the other hand, use may be made of components having comparatively low admissible maximum operating voltages, as the motor voltages occurring overall during operation of the electric motor are limited in terms of the amount to the nominal operating voltage of the electric motor.

Another embodiment provides for the limiting voltage to correspond at most to the protective DC voltage for electrical appliances. The protective extra-low voltage in the sense of the present application corresponds to that voltage that is allowed by law without special preventative measures for electrical insulation having to be taken. The protective extra-low voltage is for example 42 volts.

Further embodiments relate to the implementation of the voltage limiter circuit. A first possible embodiment provides two oppositely-poled Zener diodes connected in series. Another possible embodiment provides a bipolar limiter diode.

Another possible embodiment provides a varistor.

A further possible embodiment provides the use of a voltage limiter circuit containing an electronic load.

While the voltage limiter circuits embodied with diodes and transistors have a high response speed, the varistor can briefly absorb and thermally discharge a comparatively high power.

A combination of various components allows optimisation with regard to various requirements.

An advantageous development of the screwdriver according to the invention makes provision for the activation circuit to provide the switch-off signal, when the set desired torque value has been reached, based on a comparison of the desired torque value to an actual torque value obtained from the electric motor current. The electric motor current, which is adduced as the basis for a measure of the torque provided by the screwdriver, can be detected using simple means in terms of circuitry and is therefore much less expensive than a mechanical solution such as, for example, a slip coupling.

Another development of the power screwdriver according to the invention provides, as the energy source for the electric motor, a lithium-based battery owing to its comparatively high energy density. Use may be made of, for example, a lithium ion battery (Li ion battery) or, for example, a lithium polymer battery (Li polymer battery).

The supply voltage, which falls during operation of the power screwdriver owing to the falling battery voltage during the discharging process, is advantageously compensated for by a battery voltage drop compensation circuit, so that the falling operating voltage has no influence on the reaching of the set desired torque value.

Instead of intervening in the power section of the activation electronics, one embodiment provides for the battery voltage drop compensation circuit to either increase the specified desired torque value or reduce the actual torque value detected indirectly on the basis of the electric motor current if the battery voltage falls. The characteristic curve of the electric motor is thus virtually displaced.

Further advantageous embodiments and developments of the power screwdriver according to the invention will emerge from the following description. Exemplary embodiments of the power screwdriver according to the invention are illustrated in the drawings and described in greater detail in the following description.

Figure 1:
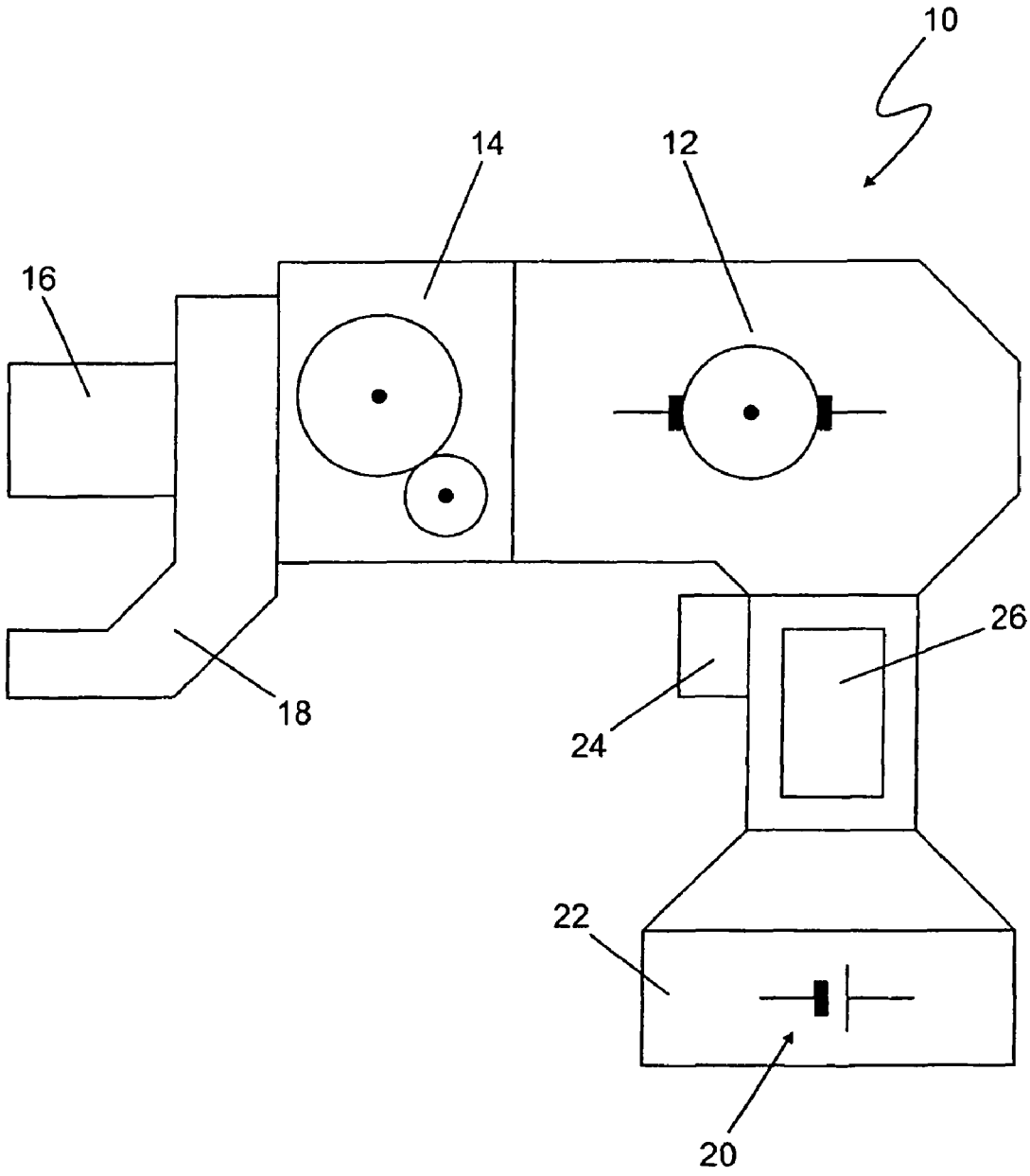
FIG. 1 is a sketch of a power screwdriver according to the invention.

FIG. 1 is a sketch of a power screwdriver 10 containing an electric motor 12 which drives a socket 16 via a gear mechanism 14. The power screwdriver 10 contains a supporting arm 18 which provides a counter-torque during the screwing process. The starting point of the exemplary embodiment shown is a battery-operated power screwdriver 10 containing a battery 20 which is accommodated in a battery part 22. The power screwdriver 10 is started up using a switch 24. An activation circuit 26 is provided for controlling the electric motor 12.

The starting point of the exemplary embodiment shown is a DC motor 12 which is preferably activated by a pulse width-modulated signal which defines the average operating voltage of the electric motor 12.

Figure 2:
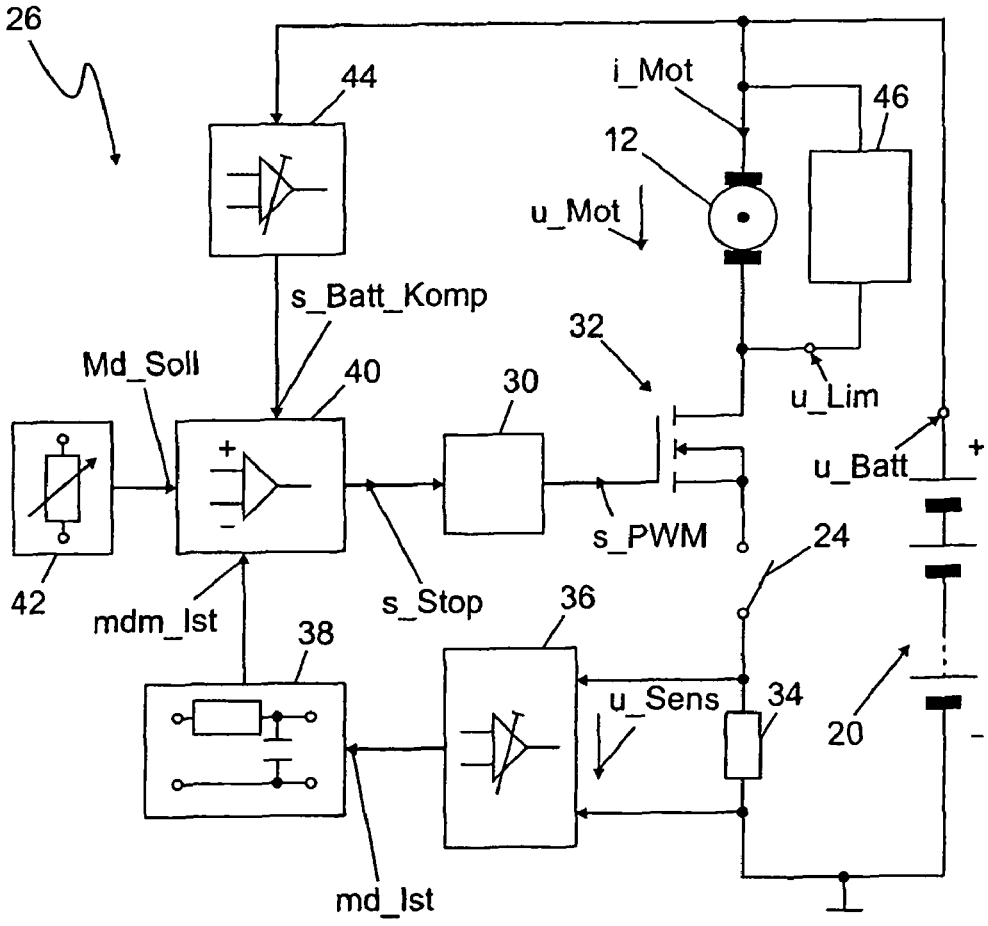
FIG. 2 is a block diagram of an activation circuit of the power screwdriver according to the invention.

FIG. 2 shows a pulse width modulator 30 which provides a pulse width-modulated signal s_PWM which either completely opens or completely closes a switching element 32, for example a MOS field effect transistor. The period duration and/or the pulse duration of the pulse-width modulated signal s_PWM may be variable.

The duty factor of the pulse width-modulated signal s_PWM, which reflects the ratio of the switch-on duration to the period duration, defines the average operating voltage of the electric motor 12 and allows, as a result, the power provided to the electric motor 12 or the speed of the electric motor 12 to be influenced.

After the switch 42 has been closed, a motor current i_Mot flows as a function of the duty factor of the pulse width-modulated signal s_PWM, as a function of the supply voltage u_Batt and as a function of the load of the electric motor 12.

The motor current i_Mot is adduced as a measure of the torque applied by the electric motor 12 and thus as a measure of the torque provided by the power screwdriver 10 to the socket 16. In the exemplary embodiment shown the motor current i_Mot is detected using a shunt 34 which is embodied as a resistor having a low resistance of, for example, 0.01 ohm. The voltage drop u_Sens, which occurs on the shunt 34 as a measure of the motor current i_Mot, is amplified in a sensor signal processing element 36 and supplied, as a measure of the actual torque value md_Ist, to a signal smoothing element 38 which provides a smoothed actual torque value mdm_Ist to a screwdriver switch-off element 40.

The sensor signal processing element 36 contains for example an op amp which is wired as a differential amplifier. The signal smoothing element 38 is for example embodied as a resistor/capacitor combination having a lowpass filter function or an integrating property leading to sliding averaging.

The signal smoothing element 38 which may be provided substantially suppresses interfering signals and current peaks which can lead to erroneous switching-off of the power screwdriver 10.

The screwdriver switch-off element 40 is for example embodied with an op amp which is wired as a comparator and to which the smoothed actual torque value mdm_Ist or the actual torque value md_Ist and a desired torque value Md_Soll provided by desired torque specification element 42 are provided. The desired torque specification element 42 is preferably a potentiometer, the dial of which, which is accessible to an operator of the power screwdriver 10, is labelled with the different desired torque values to be specified.

As soon as the smoothed actual torque value mdm_Ist or the actual torque value md_Ist corresponds to the desired torque value Md_Soll, the screwdriver switch-off element 40 provides a stop signal s_Stop which is provided to the pulse width modulator 30. With the occurring of the stop signal s_Stop when the specified desired torque value Md_Soll has been reached, the pulse width modulator 30 ends the provision of the pulse width-modulated signal s_PWM, as a result of which the switching element 32 is permanently closed and the electric motor 12 or the power screwdriver 10 is switched off.

The exemplary embodiment shown assumes that the battery 20, which is preferably embodied as a lithium-based battery 20 which is distinguished by high energy density, is used for supplying energy to the electric motor 12. Use may be made of, for example, a lithium ion battery or, for example, a lithium polymer battery. The battery 20 provides the supply voltage u_Batt. Although the discharge characteristic curve of a battery, in particular a lithium-based battery, runs relatively flat, even a small voltage drop has a direct effect on the reaching of the specified desired torque value Md_Soll if the motor current i_Mot is adduced as a measure of the actual torque value md_Ist, mdm_Ist, as a lower motor current i_Mot is set as the supply voltage u_Batt falls.

A battery voltage drop compensation circuit 44 is therefore provided that compensates for the influence of a falling supply voltage u_Batt on the reaching of the set desired torque value Md_Soll.

In principle, the supply voltage u_Batt could be immediately stabilised and kept constant, although this would require power semiconductor components which on the one hand are relatively cost-intensive and on the other hand are, owing to the high anticipated currents of up to, for example, 100 A, too bulky to be able to be accommodated in the power screwdriver 10.

The battery voltage drop compensation circuit 44 therefore intervenes in the screwdriver switch-off element 40, preferably by means of a compensation signal s_Batt_Komp, either the desired torque value Md_Soll being increased or the actual torque value md_Ist, mdm_Ist being reduced as the supply voltage u_Batt falls.

The battery voltage drop compensation circuit 44 can for example contain a reference voltage source to which the supply voltage u_Batt is compared. As the difference between the reference voltage and the supply voltage u_Batt becomes smaller during the process of discharging the battery 20, the compensation signal s_Batt_Komp is constantly increased, the increase corresponding to a virtual reduction of the motor current i_Mot in order to compensate in the signal evaluation for the actually lower motor current i_Mot as the supply voltage u_Batt falls.

During operation of the power screwdriver 10, the supporting arm 18 provides the required counter-torque to the torque transmitted from the socket 16 to the screw joint. The supporting arm 18 should be fixed to a suitable support for preparing the screwing process. During the screwing process there occurs, as a function of the increasing torque, correspondingly increasing deformation of the supporting arm 18 that corresponds to storage of energy. The energy stored in the supporting arm 18 has, after the screwdriver 10 has been switched off on reaching the specified set desired torque value Md_Soll, the maximum value.

As a result of the deformation of the supporting arm 18, the socket 16, and thus the power screwdriver 10 as a whole, is braced on the screwed connection. After the power screwdriver 10 has been switched off by way of the switch-off signal s_Stop provided by the screwdriver switch-off element 40, the energy stored in the supporting arm 18 causes the electric motor 12 to be driven, starting from the socket 16, backward via the gear mechanism 14, wherein the electric motor 12 begins to rotate in the opposite direction to the direction of drive.

The electric motor 12 is therefore operated as a generator during the dissipation of the energy stored in the supporting arm 18. For rapid and simple dissipation of the energy stored in the supporting arm 18, the electric motor 12 should be able to rotate freely, without applying a counter-torque which would hinder and lengthen the discharging process. The electric motor 12 should therefore not be short-circuited or bridged with low resistance in this operating state, wherein a high motor current i_Mot, corresponding to a high counter-torque, would occur even at a low generator voltage. It should be borne in mind in this case that, in generator mode, the polarity of the motor voltage u_Mot is reversed, owing to the different direction of rotation, and the motor current i_Mot therefore flows in the opposite direction, provided that the flow path is available.

In particular, tests have revealed that, in generator mode, considerable motor voltages u_Mot can occur lying well above the nominal operating voltage of the electric motor 12. In an electric motor 12 having a nominal operating voltage of, for example, 28 volts, voltage peaks of up to above 200 volts having a pulse duration of several hundred ns were demonstrated. Such high-energy overvoltages can lead to the destruction of components of the activation circuit 26, in particular to the destruction of the switching element 42.

According to the invention, the voltage limiter circuit 46 is therefore provided that limits the motor voltage u_Mot, occurring on the electric motor 12, of the electric motor 12, which is operated as a generator during the dissipation of the energy stored in the supporting arm 18 and rotates counter to the direction of drive, to a specified limiting voltage u_Lim.

The voltage limiter circuit 46 is not comparable to a free-wheeling element which substantially short-circuits merely the electric motor 12. The voltage limiter circuit 46 allows the limiting voltage u_Lim to be specified in a targeted manner, so that the electric motor 12 does not generate any counter-torque during generator operation, on the destruction of the energy stored in the supporting arm 18, at least until the limiting voltage u_Lim has been reached. In this operating state a motor current i_Mot occurs in the opposite direction compared to normal operation only if the motor voltage u_Mot attempts, in generator mode, to exceed the limiting voltage u_Lim.

Nevertheless, the voltage limiter circuit 46 can assume the function of a free-wheeling element, the limiting voltage u_Lim occurring as the motor voltage u_Mot during the free-wheeling in which the direction of the motor current i_Mot is not reversed. If appropriate, a switched free-wheeling element (not shown in greater detail) may be provided that is activated by the pulse width-modulated signal s_PWM.

Figure 3A:
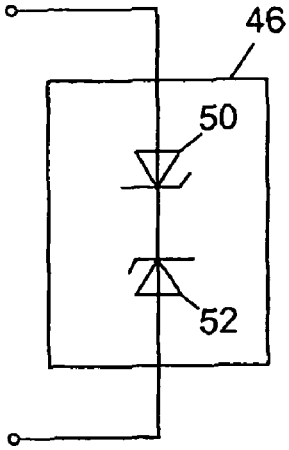
FIGS. 3*a*-3*d* show different embodiments of a voltage limiter circuit.

The voltage limiter circuit 46 can be embodied in different ways. In the exemplary embodiment shown in FIG. 3*a* the voltage limiter circuit 46 contains two oppositely-poled Zener diodes 50, 52 connected in series. The breakdown voltages are preferably defined so as to be at the same level. Apart from the forward voltages of the diodes 50, 52 in the forward direction, the breakdown voltages correspond at least approximately to the breakdown voltage u_Lim both in the positive and in the negative direction. In principle, different limiting voltages can be specified by way of a corresponding selection of the breakdown voltages of the Zener diodes 50, 52 as a function of the polarity.

Figure 3B:
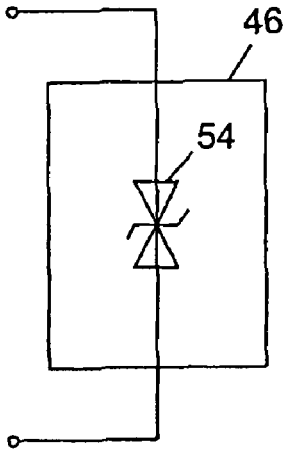

In the exemplary embodiment shown in FIG. 3*b* the voltage limiter circuit 46 contains a bipolar voltage limiter diode 54 which is also referred to as a TVS (transient voltage suppressor). The voltage limiter diode 54 contains the two Zener diodes 50, 52 integrated in a single component which is thus more economical than individual Zener diodes and can, in particular, be fitted less expensively to a printed circuit board, so that further cost advantages are obtained in series production.

Figure 3C:
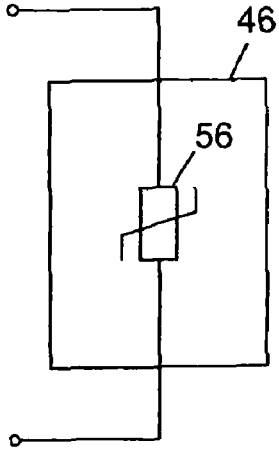

In the exemplary embodiment shown in FIG. 3*c* the voltage limiter circuit 46 contains a varistor 56.

Figure 3D:
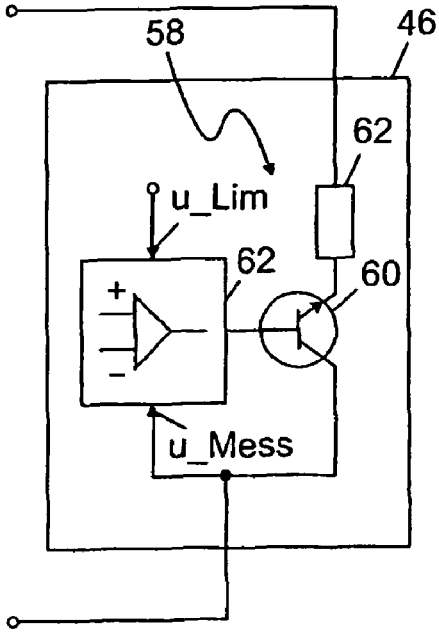

The exemplary embodiment shown in FIG. 3*d* is based on a voltage limiting element with an analogue electronic load 58. The electronic load 58 can be embodied by a transistor 60 which is connected in series with a loss resistor 62. A comparator 64, which compares the motor voltage u_Mot as the measured voltage u_Mess to the specified limiting voltage u_Lim and opens the transistor 60 to a greater or lesser degree as a function of the comparison, is provided for activating the transistor 60. As a result, the voltage on the voltage limiter circuit 46 is set to the limiting voltage u_Lim and thus limited.

While the components used in the voltage limiter circuits 46—the Zener diodes 50, 52, the voltage limiter diode 54 and also the transistor 60—allow very rapid reaction to voltage pulses, the varistor 56 can absorb and discharge more energy, at least in the short term. A combination of diodes or transistors 50, 52, 54, 60 and also a varistor 60 may therefore be provided as required.

The limiting voltage u_Lim is first set to a value at which no limitation of the motor voltage u_Mot can occur in normal drive mode of the electric motor 12. The limiting voltage u_Lim is accordingly set, in the case of a 28-volt electric motor 12, to a value of at least 28 volts. As the motor voltage u_Mot is reversed in the generator mode of the electric motor 12, the voltage limiter circuit 46 has to provide the limiting voltage u_Lim, in particular for the motor voltage u_Mot at reversed polarity, as there is the risk of overvoltage, in particular in generator mode. In the exemplary embodiment shown, with the polarity of the supply voltage u_Batt entered in FIG. 2, the positive potential of the motor voltage u_Mot occurs, in the generator mode of the electric motor 12, on the switching element 32, while the negative potential is applied to the battery 20.

Expediently, the same amount of the limiting voltage u_Lim, which corresponds at least to the amount of the nominal operating voltage of the electric motor 12, is specified for both polarities of the motor voltage u_Mot.

According to another embodiment, at least the limiting voltage u_Lim, which is operative in the generator mode of the electric motor 12, is set to the value of what is known as a protective extra-low voltage which may be defined by law. A protective extra-low voltage in this sense should be defined in that, on an electrical apparatus, in the present case the power screwdriver 10, live parts, which can be contacted, may not exceed the protective extra-low voltage. If this might be the case, special measures must be taken for protection against accidental contact. The protective extra-low voltage is for example at 42 volts. Preferably, the limiting voltage u_Lim, which is set to the protective extra-low voltage, is also set to the same amount for both polarities of the motor voltage u_Mot.

The invention claimed is:

1. Power screwdriver with an electric motor (12) and with an activation circuit (22) which switches off the electric motor (12) by means of a switch-off signal (s_Stop) when a set desired torque value (Md_Soll) has been reached, and also with a supporting arm (18) which absorbs energy during the screwing process, wherein a voltage limiter circuit (46) is provided that limits to a specified limiting voltage (u_Lim) the motor voltage (u_Mot) which occurs on the electric motor (12) which is operated as a generator during the dissipation of the energy stored in the supporting arm (18) and rotates counter to the direction of drive.

2. Power screwdriver according to claim 1, wherein the limiting voltage (u_Lim) corresponds at least to the nominal operating voltage of the electric motor (12).

3. Power screwdriver according to claim 1, wherein the limiting voltage (u_Lim) corresponds at most to a protective extra-low voltage.

4. Power screwdriver according to claim 1, wherein the voltage limiter circuit (46) contains two oppositely-poled Zener diodes (50, 52) connected in series.

5. Power screwdriver according to claim 1, characterised in that the voltage limiter circuit (46) contains a bipolar limiter diode (54).

6. Power screwdriver according to claim 1, wherein the voltage limiter circuit (46) contains a varistor (56).

7. Power screwdriver according to claim 1, wherein the voltage limiter circuit (46) contains an electronic load (58).

8. Power screwdriver according to claim 1, wherein the activation circuit (22) provides the switch-off signal (s_Stop), when the set desired torque value (Md_Soll) has been reached, by comparing an actual torque value (md_Ist, mdm_Ist), obtained from the electric motor current (i_Mot), to the desired torque value (Md_Soll).

9. Power screwdriver according to claim 1, wherein a battery (20) is provided as the energy source for the electric motor (12).

10. Power screwdriver according to claim 9, wherein the battery (20) provided is a lithium-based battery (Li ion battery, Li polymer battery).

11. Power screwdriver according to claim 9, wherein a battery voltage drop compensation circuit (44) is provided that compensates for the influence of a falling operating voltage (u_Batt) on the reaching of the set desired torque value (Md_Soll).

12. Power screwdriver according to claim 9, wherein the battery voltage drop compensation circuit (44) increases the desired torque value (Md_Soll) specified for reaching the set desired torque value (Md_Soll) if the supply voltage (u_Batt) falls.

13. Power screwdriver according to claim 9, wherein the battery voltage drop compensation circuit (44) reduces the actual torque value (md_Ist, mdm_Ist) detected for reaching the set desired torque value (Md_Soll) if the supply voltage (u_Batt) falls.

* * * * *